US007878725B2

(12) United States Patent
Ohkubo et al.

(10) Patent No.: US 7,878,725 B2
(45) Date of Patent: Feb. 1, 2011

(54) IMAGE FORMING APPARATUS HAVING REMOVABLE UNITS

(75) Inventors: Yasuhide Ohkubo, Osaka (JP); Hiroshi Fujiwara, Osaka (JP); Shigeo Nanno, Kyoto (JP); Ippei Kimura, Osaka (JP); Yoshihide Ohta, Kanagawa (JP); Tomoyoshi Yamazaki, Tokyo (JP); Masafumi Takahira, Tokyo (JP); Haruyuki Honda, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 831 days.

(21) Appl. No.: 11/808,610

(22) Filed: Jun. 12, 2007

(65) Prior Publication Data

US 2008/0006166 A1 Jan. 10, 2008

(30) Foreign Application Priority Data

Jun. 12, 2006 (JP) ..... 2006-162350
Apr. 10, 2007 (JP) ..... 2007-102551
Apr. 24, 2007 (JP) ..... 2007-114172

(51) Int. Cl.
*G03G 21/16* (2006.01)

(52) U.S. Cl. ..... 400/692; 399/113

(58) Field of Classification Search ..... 400/692
See application file for complete search history.

(56) References Cited

U.S. PATENT DOCUMENTS 5,587,769 A 12/1996 Sawada et al.
5,787,326 A * 7/1998 Ogawa et al. ..... 399/124
5,797,069 A * 8/1998 Kimura et al. ..... 399/113
5,887,228 A * 3/1999 Motohashi et al. ..... 399/111
5,991,570 A * 11/1999 Haga et al. ..... 399/114
6,122,474 A * 9/2000 Asakura et al. ..... 399/297
6,134,404 A * 10/2000 Iwai et al. ..... 399/110
6,453,135 B1 * 9/2002 Sameshima et al. ..... 399/110
6,678,490 B2 * 1/2004 Tanaka ..... 399/124
6,775,496 B2 * 8/2004 Kida ..... 399/124

(Continued)

FOREIGN PATENT DOCUMENTS

JP 02-135375 5/1990

(Continued)

OTHER PUBLICATIONS

Chinese Office Action dated Dec. 5, 2008 and English translation thereof.

*Primary Examiner*—Jill E Culler
(74) *Attorney, Agent, or Firm*—Harness, Dickey & Pierce, P.L.C.

(57) ABSTRACT

An image forming apparatus is disclosed. The image forming apparatus includes an apparatus main body, a first unit to be attached inside the apparatus main body, a rotatable part attached to the apparatus main body and rotatable between an open position for opening the apparatus main body and a closed position for closing the apparatus main body, and a second unit removably attached to the rotatable part. When the rotatable part is rotated from the closed position to the open position, the first unit is allowed to be attached to or removed from the apparatus main body by being moved horizontally. By removing the second unit from the rotatable part, the first unit is attached to or removed from the apparatus main body without coming into contact with the second unit.

14 Claims, 9 Drawing Sheets

U.S. PATENT DOCUMENTS

| | | | | |
|---|---|---|---|---|
| 2003/0118367 | A1* | 6/2003 | Omata et al. | 399/110 |
| 2006/0104661 | A1* | 5/2006 | Nakanishi | 399/110 |

FOREIGN PATENT DOCUMENTS

| | | |
|---|---|---|
| JP | 05-014657 | 1/1993 |
| JP | 06-19239 | 1/1994 |
| JP | 08-087227 | 4/1996 |
| JP | 09-185309 | 7/1997 |
| JP | 10-115961 | 5/1998 |
| JP | 2000-194203 | 7/2000 |
| JP | 2002-062698 | 2/2002 |
| JP | 2003-215941 | 7/2003 |
| JP | 2004-053987 | 2/2004 |
| JP | 2004-258199 | 6/2004 |
| JP | 2004-205534 | 7/2004 |
| JP | 2005148411 | 6/2005 |
| JP | 2005-266545 | 9/2005 |

* cited by examiner

IMAGE FORMING APPARATUS HAVING REMOVABLE UNITS

BACKGROUND OF THE INVENTION

1. Field of the Invention

The present invention relates to an image forming apparatus including a printer, a facsimile machine, a copier, and a multifunction machine having functions of at least two of these machines.

2. Description of the Related Art

<Patent Document 1> Japanese Patent Laid-Open Publication No. 2004-205534

In development of image forming apparatuses, downsizing of the apparatuses is one important issue. For downsizing the apparatuses, component parts need to be arranged with high space efficiency while reducing excess space inside the apparatus. Patent Document 1 discloses an image forming apparatus that includes an exterior panel of an apparatus main body configured as a rotatable door and, on the inner surface of the door is mounted a unit such as a transport unit.

An image forming apparatus of this type has a problem in that, when carrying out maintenance or replacement of an internal unit disposed inside the apparatus, the unit on the inner surface of the door often impedes maintenance or replacement of the internal unit.

As one way of resolving this problem, it has been proposed to make the unit on the door detachable therefrom so as to be removed from the door when impeding the maintenance or replacement work. However, if the unit is made easily attachable and detachable, the unit is likely to be attached with low positional accuracy. On the other hand, if the unit is fixed by screws or the like for high positional accuracy, it takes time to attach and remove the unit because of the use of tools.

SUMMARY OF THE INVENTION

In view of the foregoing, the present invention is directed to provide an image forming apparatus that satisfies two competing demands: facilitating attachment/removal of a unit; and ensuring positional accuracy thereof.

According to an aspect of the present invention, there is provided an image forming apparatus comprising an apparatus main body, a first unit to be attached inside the apparatus main body, a rotatable part attached to the apparatus main body and rotatable between an open position for opening the apparatus main body and a closed position for closing the apparatus main body, and a second unit removably attached to the rotatable part. When the rotatable part is rotated from the closed position to the open position, the first unit is allowed to be attached to or removed from the apparatus main body by being moved horizontally. By removing the second unit from the rotatable part, the first unit is attached to or removed from the apparatus main body without coming into contact with the second unit.

It is preferable that the rotatable part include a support member that supports the second unit attached to the rotatable part in a manner movable for adjustment in directions toward and away from the rotatable part.

It is also preferable that the rotatable part include a biasing member that constantly exerts an elastic force on the second unit in the direction away from the rotatable part.

It is also preferable that the second unit include a positioning portion that is brought into contact with a predetermined portion of the apparatus main body due to the elastic force of the biasing member.

It is also preferable that, when the rotatable part is rotated from the open position to the closed position, the positioning portion be pressed against the predetermined portion of the apparatus main body by the biasing member, so that the second unit is positioned.

It is also preferable that the support member include a locking claw slidably movable between an engaging position for engaging a locking portion of the second unit and a disengaging position for releasing the engagement, the locking claw having a taper portion that, during attachment of the second unit, comes into contact with the locking portion to cause the sliding movement of the locking claw from the engaging position to the disengaging position.

It is also preferable that the locking claw be constantly biased by a force that moves the locking claw to the engaging position so that, when the locking portion moves over the taper portion during attachment of the second unit, the locking claw returns to the engaging position.

It is also preferable that the second unit include a registration roller for registration of a sheet.

It is also preferable that handles be provided one on each longitudinal end of the second unit, the handles being operated for removing the second unit from the rotatable part.

It is also preferable that the first unit be attached to or removed from the apparatus main body without coming into contact with a registration roller of the second unit by removing the second unit from the rotatable part.

It is also preferable that the second unit be a transport unit that includes a pair of registration rollers and a transfer member and transports sheets fed from a sheet feed section to an image transfer section.

It is also preferable that the sheet feed section include a transport roller for transporting the sheets and a separation member that separates the sheets adhering to each other, and that a sheet holding force of the pair of registration rollers be greater than the a sheet holding force between the transport roller and the separation member.

It is also preferable that a fixing unit including a pair of fixing rollers be disposed downstream of the pair of registration rollers in a sheet transport direction, and that a sheet holding force of the pair of fixing rollers be greater than a sheet holding force of the pair of registration rollers.

It is also preferable that the first unit include at least an intermediate transfer belt.

According to embodiments of the present invention, since the second unit is removable from the rotatable part, maintenance of components inside the apparatus main body is easily carried out. Moreover, since the direction in which the unit to be removed is moved and the attaching/removing direction are the same, maintenance work is facilitated.

Embodiments of the present invention make it possible to remove the second unit with ease and attach the second unit with high positional accuracy. If the second unit includes the transport unit, a paper jam is easily resolved.

DETAILED DESCRIPTION OF THE PREFERRED EMBODIMENT

The following describes preferred embodiments of the present invention with reference to the accompanying drawings.

Figure 1:
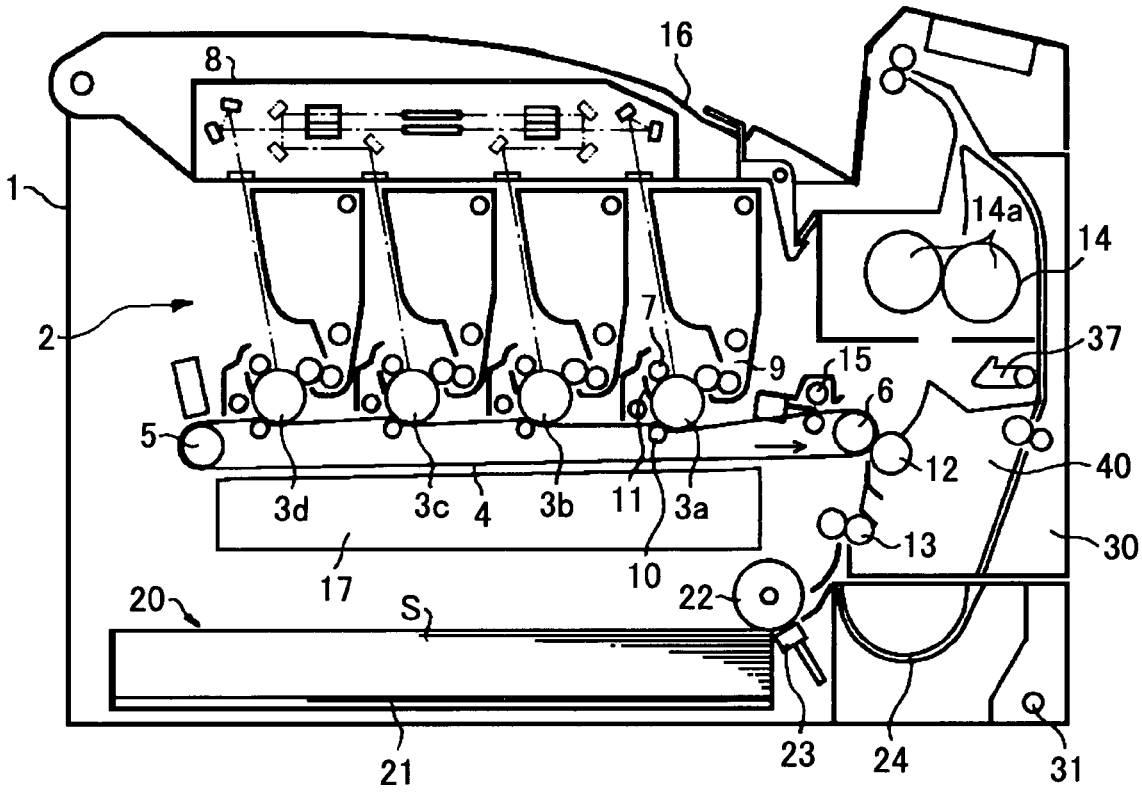
FIG. 1 is a cut-away side view schematically showing an image forming apparatus according to an embodiment of the present invention.

FIG. 1 is a cut-away side view schematically showing an image forming apparatus according to an embodiment of the present invention.

With reference to FIG. 1, the image forming apparatus of this embodiment is a tandem type color image forming apparatus that includes an image forming section 2 in the center of an apparatus main body 1 and, under the image forming section 2, a sheet feed section 20 for feeding sheets on which images are to be formed in the image forming section 2.

The image forming section 2 includes drum-type photoreceptors 3*a*, 3*b*, 3*c*, and 3*d* (hereinafter also referred to as photoreceptors 3) as image carriers, on which toner images are formed in different colors. In the illustrated example, a yellow toner image, a magenta toner image, a cyan toner image, and a black toner image are formed on the surfaces of the photoreceptors 3*a*, 3*b*, 3*c*, and 3*d*, respectively. The photoreceptors 3*a* through 3*d* are arranged parallel to each other at predetermined space intervals. An intermediate transfer belt 4 as a first unit is disposed under the photoreceptors 3*a* through 3*d* so as to face them. In the illustrated example, the intermediate transfer belt 4 is an endless belt, which is wound around support rollers 5 and 6 and rotates in the direction indicated by the arrow of FIG. 1.

In the vicinity of the photoreceptors 3, there are provided charging units 7 for charging the surfaces of the photoreceptors 3, a light scanning unit (LSU) 8 for emitting a laser beam onto the surfaces of the photoreceptors 3 according to image information, development units 9 for visualizing electrostatic latent images formed on the surfaces of the photoreceptors 3, transfer units 10 facing the photoreceptors 3 thorough the intermediate transfer belt 4, and cleaning units 11 for removing and collecting residual toner on the surfaces of the photoreceptors 3 after transferring toner images onto the intermediate transfer belt 4.

When the image forming apparatus starts image forming processing, the photoreceptor 3 rotates clockwise as viewed in FIG. 1, while the charging unit 7 charges the surface of the photoreceptor 3 with a predetermined polarity. Then, the light scanning unit 8 emits a laser beam onto the charged surface according to image information, so that an electrostatic latent image is formed on the photoreceptor 3. The electrostatic latent image formed on the surface of the photoreceptor 3 is visualized as a toner image by the development unit 9, and the toner image is transferred onto the intermediate transfer belt 4 by the transfer unit 10.

For forming a color image, each of the photoreceptors 3 performs the above-described image forming operation. A yellow toner image, a cyan toner image, a magenta toner image, and a black toner image formed on the photoreceptors 3*a*, 3*b*, 3*c*, and 3*d*, respectively, are sequentially transferred onto the intermediate transfer belt 4. In the image forming apparatus, a secondary transfer roller 12 is disposed facing the support roller 6 with the intermediate transfer belt 4 inbetween.

The sheet feed section 20 under the image forming section 2 is provided with a sheet feed tray 21 as a sheet container for stacking therein sheets S, including transfer paper, resin films, etc., a sheet feed roller 22 for feeding the sheets S stacked in the sheet feed tray 21, a friction pad 23 as a separation member for separating the sheets S adhering to each other, and a re-transport path 24 used for double-side image forming. It is to be noted that a torque limiter type reverse roller may be employed as the separation member.

The sheet S fed from the sheet feed section 20 is transported toward a registration roller pair 13 until the leading edge of the sheet S comes into contact with the suspended registration roller pair 13, by which the sheet S is aligned. After that, the registration roller pair 13 restarts rotation so as to transport the sheet S upward to a secondary transfer section, in which the secondary transfer roller 12 is provided, at such a timing that the sheet S is aligned with a color toner image formed on the intermediate transfer belt 4 in the secondary transfer section.

When the toner image is transferred onto the sheet S in the secondary transfer section, the sheet S is transported to a fixing unit 14 having a fixing roller pair 14*a*. After the fixing unit 14 fixes the toner image on the sheet S, the sheet S is ejected onto a sheet stacker 16 in the upper part of the apparatus main body 1. The toner remaining on the surface of the intermediate transfer belt 4 after the toner image has been transferred is removed by a belt cleaner 15.

The image forming apparatus is provided with an operations section (not shown) including an operations panel, etc., in the upper right part as viewed in FIG. 1. That is, the front side of the image forming apparatus is shown in the right side in FIG. 1. A front exterior panel, i.e., a front cover 30, of the apparatus main body 1 is provided as a rotatable part that is rotatable about a support point 31 between a closed position shown in FIG. 1 and an open position shown in FIG. 2. A unit comprising plural component parts is attached to this front cover 30. In this embodiment, the unit is a transport unit 40 (a second unit) that comprises the registration roller pair 13 and is adapted to transport the sheet S fed from the sheet feed section 20 to the secondary transfer section. This transport unit 40 comprises, in addition to the registration roller pair 13, the secondary transfer roller 12, guide plates 25 (not shown) at one end of the re-transport path 24, etc.

In the case of performing maintenance and replacement of the intermediate transfer belt 4 of the image forming apparatus having the configuration described above, the front cover 30 is opened. Then, because the length of the intermediate transfer belt 4 in the fore-aft direction, i.e., the depth direction is large, the intermediate transfer belt 4 is removed by being slid at least in the horizontal direction indicated by the arrow A of FIG. 2. If, however, the transport unit 40 is pulled out of the apparatus main body 1 by being slid in the direction of the arrow A of FIG. 2, the intermediate transfer belt 4 comes into contact with the registration roller pair 13 as shown in FIG. 3. This contact may damage the intermediate transfer belt 4, resulting in distortion of the image. In some cases, this contact may damage the registration roller pair 13, causing problems such as damage on the sheet S and distortion of a part of the image corresponding to the damaged part of the registration roller pair 13.

In this embodiment of the present invention, in order to avoid these problems, the transport unit 40 that interfere with removal of the intermediate transfer belt 4 is removably attached to the front cover 30. The transport unit 40 is removed from the front cover 30 for maintenance and replacement of the intermediate transfer belt 4 so as to prevent the intermediate transfer belt 4 from coming into contact with the registration roller pair 13.

Incidentally, although it is preferable that the transport unit 40 be easily removed from the front cover 30, if the transport unit 40 is reattached with low positioning accuracy, transport problems such as jamming and skewing are likely to occur. Therefore, operability and positional accuracy need to be balanced.

In order to satisfy such a need, in this embodiment of the present invention, a configuration described below is employed for facilitating placement and removal of the transport unit 40 and ensuring positional accuracy thereof.

Figure 4:
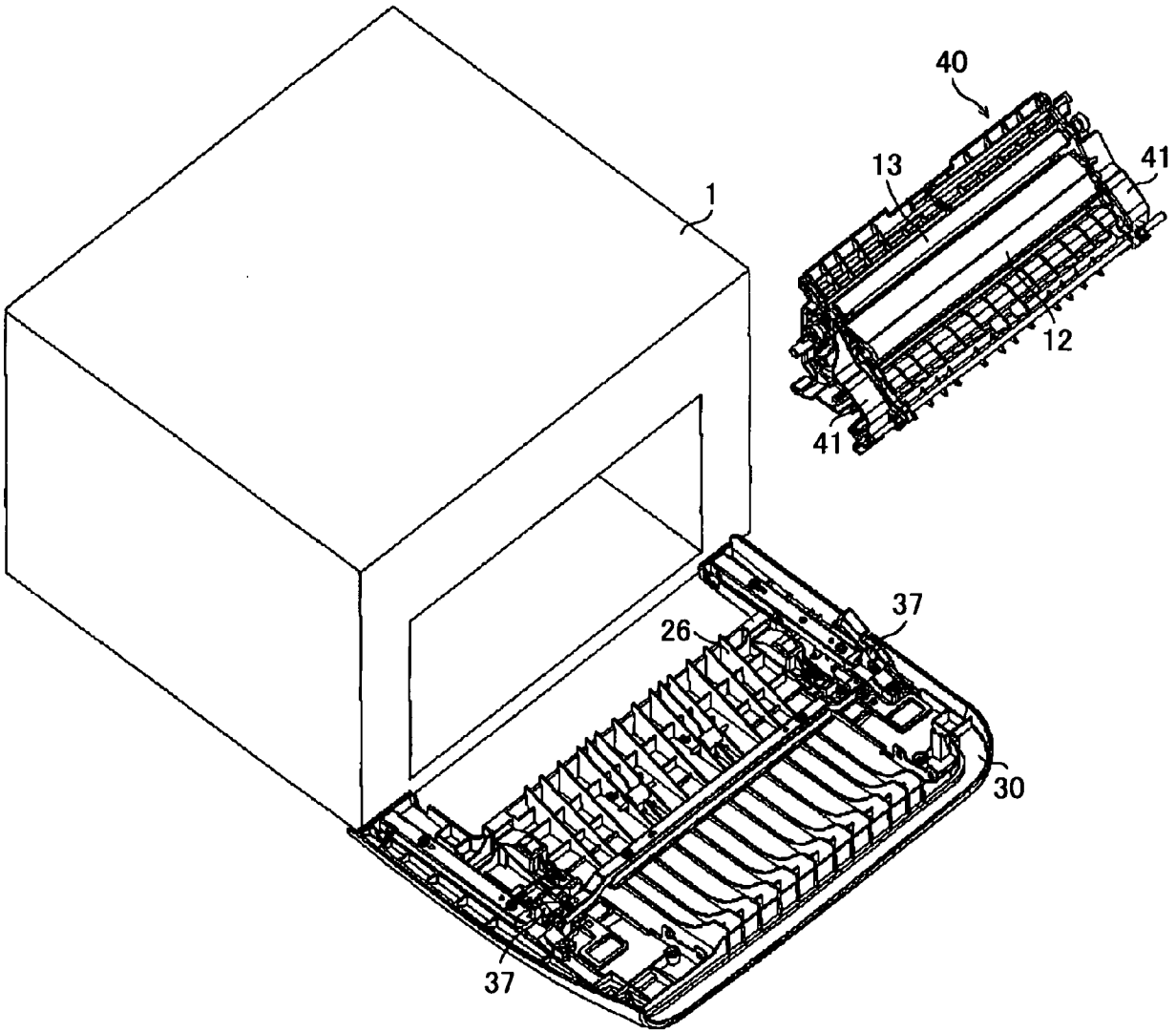
FIG. 4 is a perspective view showing the image forming apparatus of FIG. 1 with the front cover from which the transport unit has been removed.
Figure 5:
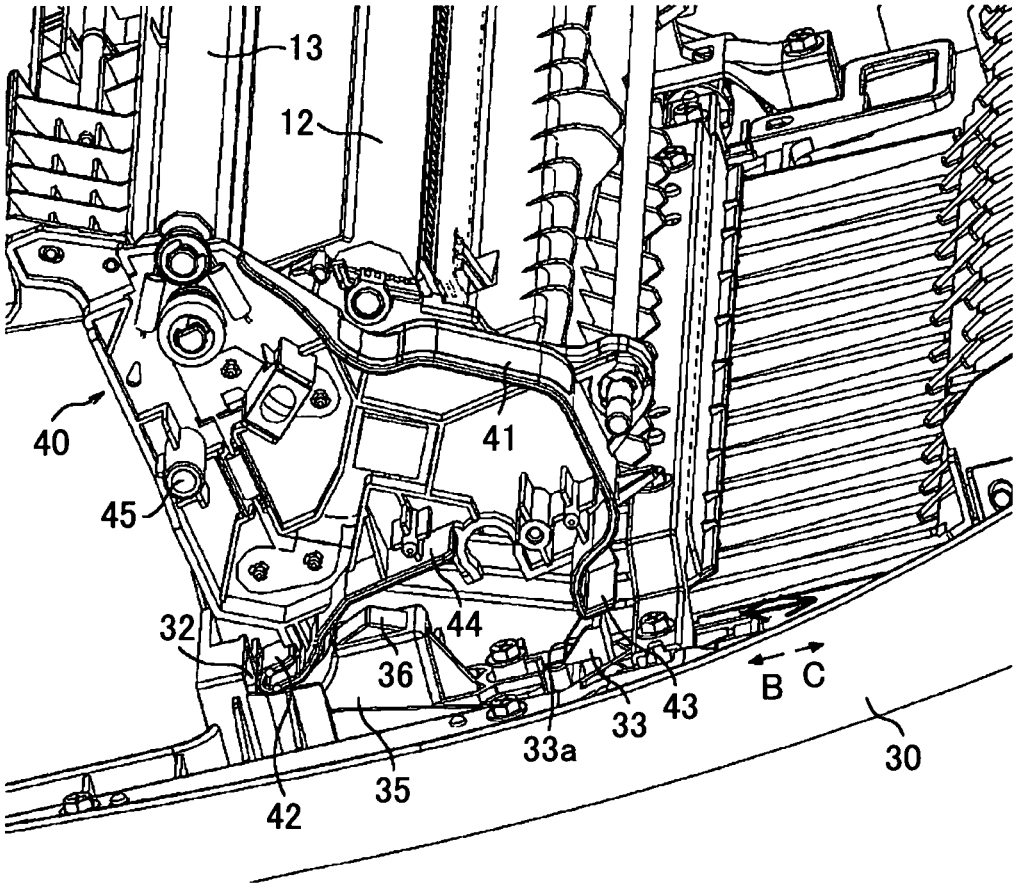
FIG. 5 is a perspective view illustrating a first step of a procedure for attaching the transport unit to the front cover.
Figure 6:
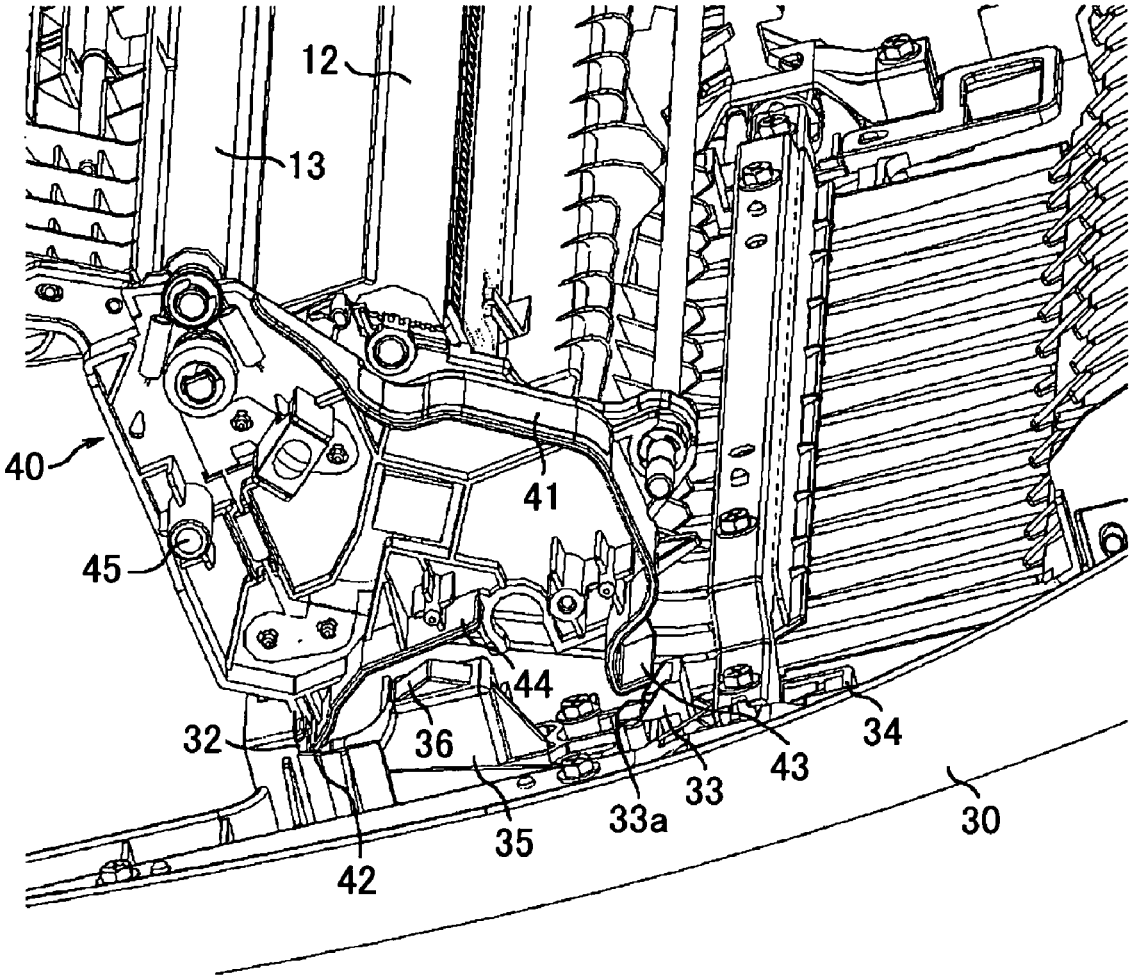
FIG. 6 is a perspective view illustrating a second step of the procedure for attaching the transport unit to the front cover.
Figure 7:
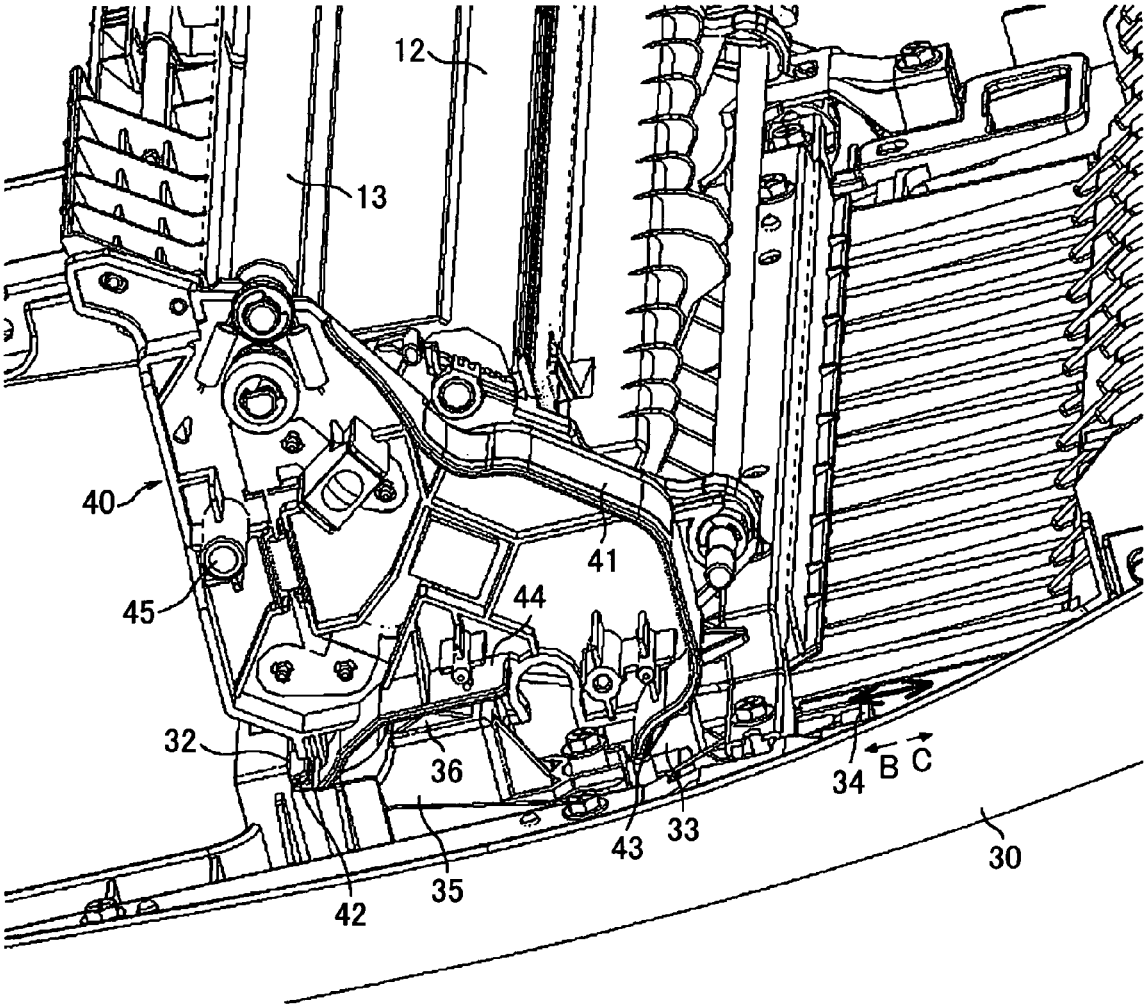
FIG. 7 is a perspective view showing the transport unit attached to the front cover.

FIG. 4 is a perspective view showing the image forming apparatus with the transport unit 40 removed from the front cover 30. FIGS. 5 through 7 are perspective views illustrating a procedure for attaching the transport unit 40 to the front cover 30.

With reference to FIG. 4, the support point 31 of the front cover 30 is located at the lower front side (see FIG. 1). When engagement by a locking claw 37 is released by manipulating the operations section (not shown), the upper part of the front cover 30 is lowered forward to be in the open position, so that a sheet path between the sheet feed section 20 and the fixing unit 14 is substantially exposed. When the transport unit 40 is removed from the opened front cover 30, as shown in FIG. 4, the re-transport path 24 for double-side printing is exposed, so that guide plates 26 at the other end of the re-transport path 24 appear. As the transport unit 40 is removed from the front cover 30, it is possible to easily remove the intermediate transfer belt 4 and a waste toner tank 17 by sliding them in the direction of the arrow A (see FIG. 2).

Figure 8:
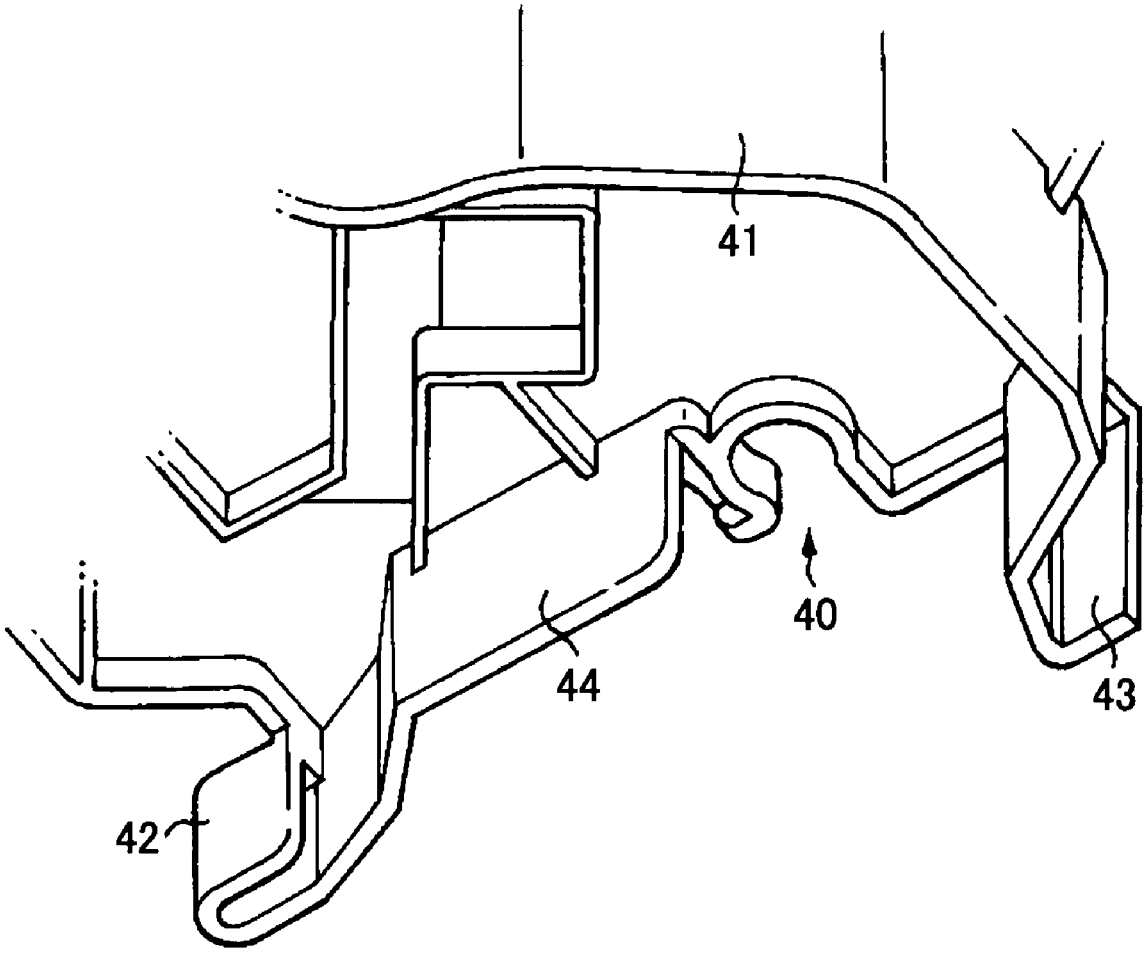
FIG. 8 is an enlarged perspective view showing a portion of the transport unit for engagement with the front cover.

The transport unit 40 includes, at each longitudinal end, a strap handle 41 with a certain width. Referring to FIG. 8, the transport unit 40 further includes, at each end, an insertion projection 42, an engagement piece 43 for fixing the transport unit 40, and an elongated receiving plate 44 for receiving an upward pushing force exerted by a biasing member (described below) upon releasing the engagement. On the other hand, the front cover 30 includes, at each end, an angled depression 32 for insertion of the projection 42, a locking member for engaging the transport unit 40 through the engagement piece 43, and the biasing member for constantly exerting an elastic force upon the transport unit 40 in a direction away from the front cover 30.

The handles 41 are located at the opposing ends of the upper part of the transport unit 40 so that when the front cover 30 is in the open position, the handles 41 are easily viewed. Moreover, each handle 41 is curved forward from the upper side toward the lower side so as to allow a user to easily hold the handle 41 with his thumb on the upper front surface of the handle 41 and other fingers on the lower back surface. This configuration improves operability of the transport unit 40.

The projections 42 are located at the opposing longitudinal ends in the lower front side (lower left side of FIG. 8) of the transport unit 40 when the front cover 30 is in the open position. Each projection 42 is formed like an elongated plate curved in a U-shape. Each angled depression 32 for insertion of the corresponding projection 42 has a rectangular shape in cross section. The projection 42 fits in the angled depression 32 with substantially no gap therebetween in the width direction but loosely in the vertical direction. Accordingly, the transport unit 40 with the projections 42 inserted in the angled depressions 32 cannot be moved in the lateral direction, but can be rotated about the projections 42 by a certain angle.

The locking member of the front cover 30 includes a locking claw 33 that engages the engagement piece 43. The locking claw 33 is attached so as to be slidable in the directions of arrows B and C of FIG. 5 and is biased by the force of a spring (not shown) in the B direction for engagement with the engagement piece 43. The locking claw 33 is normally held in an engaging position. The locking claw 33 includes at the upper part thereof a taper portion 33*a* so that, upon being pushed by the edge of the engagement piece 43, the locking claw 33 slides in the direction of arrow C against the spring force for disengaging the locking claw 33. A release lever 34 (see FIG. 6) is connected to the locking claw 33. By moving the locking claw 33 in the direction of arrow C with use of the release lever 34, the locking claw 33 is disengaged from the engagement piece 43 and thus the engagement is released.

The biasing member exerting the elastic force on the transport unit 40 in the direction away from the front cover 30 includes a pushing-up block 36. The pushing-up block 36 is configured to be vertically movably guided by a storage box 35 and has an upper portion with an angled cross section. The pushing-up block 36 is constantly subjected to an elastic force, which is exerted by a pushing-up spring (not shown), in the direction upward in FIG. 5, i.e., in a direction away from the front cover 30, so that the apex of the angled upper portion projects from the upper part of the storage box 35.

Figure 2:
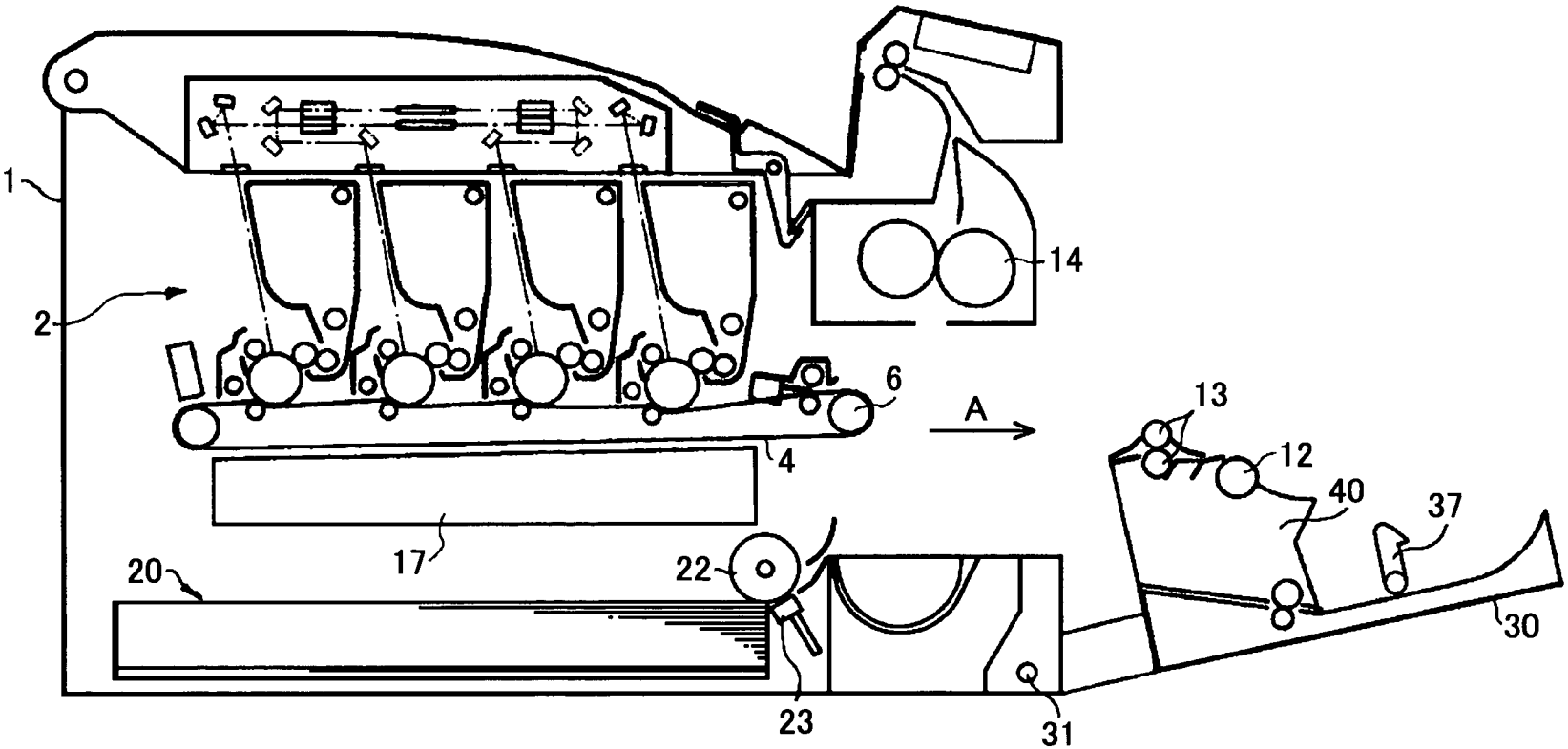
FIG. 2 is a cut-away side view schematically showing the image forming apparatus of FIG. 1 with a front cover opened.
Figure 3:
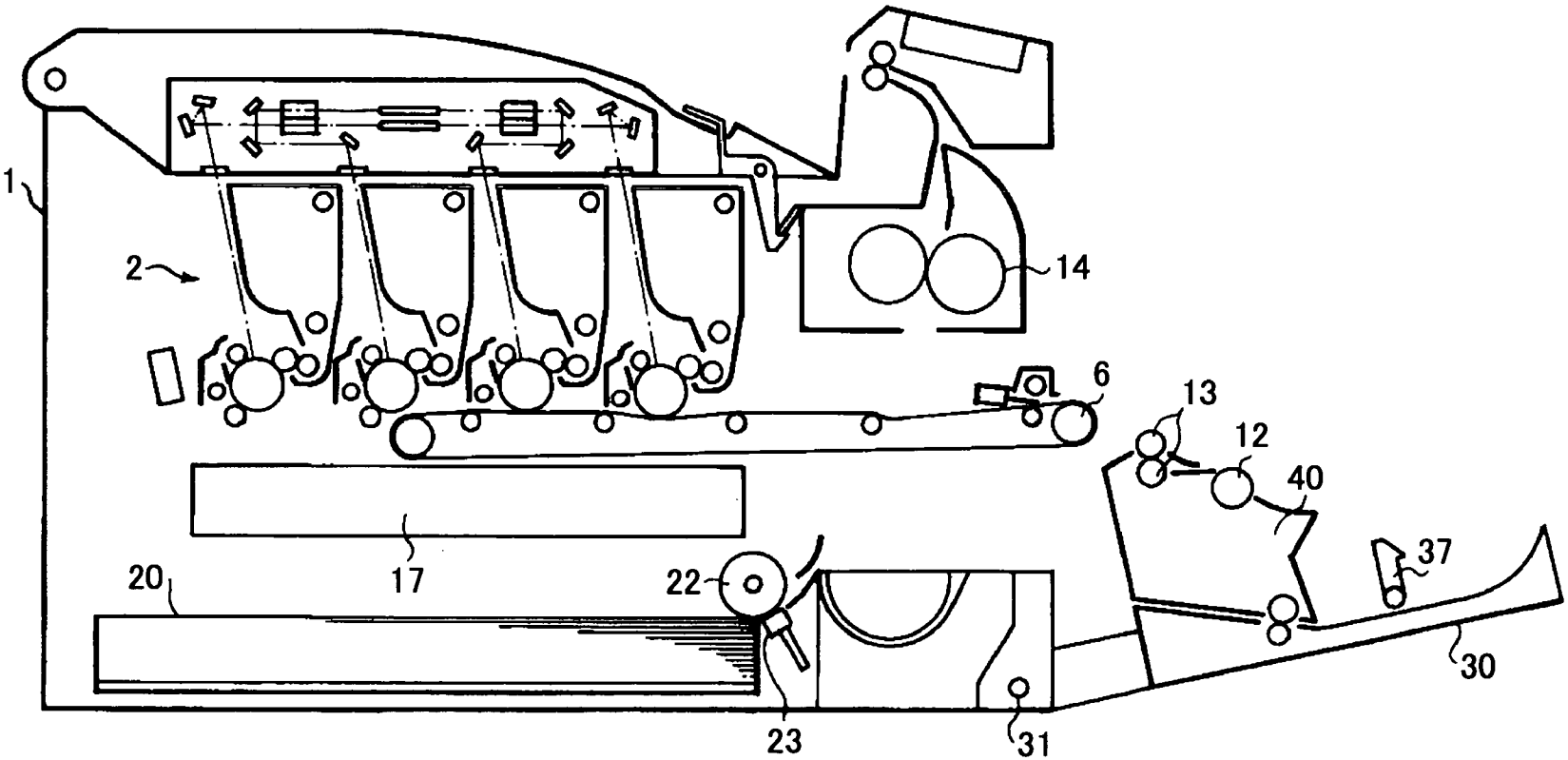
FIG. 3 is a cut-away side view schematically showing the image forming apparatus of FIG. 1 with the front cover opened for removal of a transport unit.

In the case of performing maintenance and replacement of the intermediate transfer belt 4 of the image forming apparatus having the configuration as described above, the front cover 30 is opened as shown in FIG. 2, and then the intermediate transfer belt 4 is removed by being horizontally slid. However, as the transport unit 40 attached to the front cover 30 is in the way of the removal, the transport unit 40 needs to be removed from the front cover 30.

For removing the transport unit 40 from the opened front cover 30, the release lever 34 is moved in the direction of arrow C, so that the locking claw 33 is also moved in the direction of arrow C and is disengaged from the engagement piece 43. Then, a user pulls the transport unit 40 forward with the handles 41 so as to pull the projections 42 out of the angled depression 32, and thus can easily remove the transport unit 40 from the front cover 30.

According to the present embodiment, the transport unit 40 can be removed from the front cover 30 by simply pulling the release levers 34 and then pulling the transport unit 40 forward with the handles 41. Moreover, the present embodiment eliminates combined operations such as pulling the transport unit 40 while pulling the release levers 34. Once the transport unit 40 is removed, it is possible to remove the intermediate transfer belt 4 from the apparatus main body 1 by horizontally moving the intermediate transfer belt 4.

Upon attaching the removed transport unit 40 to the front cover 30, the transport unit 40 needs to be attached with high positional accuracy relative to the intermediate transfer belt 4 in the apparatus main body 1, a gear for driving the registration roller pair 13, and transport rollers therearound. In the present embodiment, as described below, the removed transport unit 40 is reattached with high positional accuracy relative to the apparatus main body 1 with simple operations by first roughly positioning and engaging the removed transport unit 40 with respect to the front cover 30.

More specifically, a user first holds the handles 41 of the transport unit 40 with both hands and, as shown in FIG. 5, inserts the projections 42 at the opposing ends of the transport unit 40 into the angled depressions 32 of the front cover 30. After this insertion operation, the user presses the rear end of the transport unit 40 against the front cover 30, so that each engagement piece 43 at the rear end of the transport unit 40 comes into contact with the taper portion 33*a* of the locking claw 33. As a result, the locking claw 33 is moved in the direction of arrow C against the spring action. When the engagement piece 43 moves over the locking claw 33, as shown in FIG. 7, the locking claw 33 moves in the direction of arrow B due to the spring force and engages the engagement piece 43.

In this state, the transport unit 40 is not accurately positioned relative to the front cover 30 and is fixed in a manner movable for adjustment. More specifically, the transport unit 40 engaged with the front cover 30 by the locking member is fixed with play for movement in the directions toward and away from the front cover 30. Also, the transport unit 40 engaged with the front cover 30 is constantly biased in the direction away from the front cover 30 by the elastic force of the biasing member.

When the front cover 30 with the transport unit 40 engaged is rotated from the open position to the closed position, a projection 45 of the transport unit 40, which is provided as a positioning portion, abuts a predetermined fixed position (not shown) of a main body frame of the apparatus main body 1, so that the transport unit 40 is accurately positioned relative to the apparatus main body 1.

According to this embodiment of the present invention, it is possible to attach the transport unit 40 to the front cover 30 with simple operations of inserting the projections 42 at the front side into the angled depressions 32 with use of the handles 41 and pressing downward the rear side of the transport unit 40. Then, by rotating the front cover 30 from the open position to the closed position, the transport unit 40 is accurately positioned relative to the apparatus main body 1.

As mentioned above, the transport unit 40 needs to be accurately positioned relative to the intermediate transfer belt 4, the gear for driving the registration roller pair 13, and transport rollers therearound. These components are fixed to the main body frame of the apparatus main body 1. Therefore, the transport unit 40 needs to be accurately positioned relative to the main body frame of the apparatus main body 1 when the front cover 30 is rotated to the closed position. If the transport unit 40 is immovably fixed to the front cover 30 when engaged with the front cover 30, as it is impossible to adjust the position of the transport unit 40, the transport unit 40 is placed with poor positional accuracy relative to the apparatus main body 1.

According to this embodiment, at the time of engagement with the front cover 30, the transport unit 40 is loosely fixed to the front cover 30 for allowing positional adjustment. When the front cover 30 is rotated to the closed position, the projection 45 of the transport unit 40 abuts the predetermined position of the main body frame due to the elastic force of the biasing member, so that the transport unit 40 is accurately positioned relative to the apparatus main body 1.

If the transport unit 40 is movable to a large extent with respect to the front cover 30, when the front cover 30 is rotated to the closed position, the transport unit 40 might hit the periphery of the apparatus main body 1. As a result, the front cover 30 cannot be placed in the closed position, or the transport unit 40 might be damaged. In view of these problems, according to the present embodiment, the transport unit 40 is loosely fixed to the front cover 30 by a support member.

The transport unit 40 of the present embodiment includes as integral parts the secondary transfer roller 12 for transferring images onto the sheets S, the registration roller pair 13, and transport guides therearound. This configuration improves efficiency of removing paper jams. More specifically, because a transfer nip is exposed by opening the front cover 30, a jammed sheet can be easily viewed and removed. Moreover, the registration roller pair 13 is disposed in the transport unit 40 in a manner with the rollers pressing against each other. With this configuration, since a sheet jammed in the transport unit 40 remains on the front cover 30 together with the transport unit 40 without falling down inside the apparatus, the jammed sheet is easily removed. Furthermore, since the transport guides therearound are also integrated in the transport unit 40, visibility and removal efficiency of jammed sheets are further improved. Providing the secondary transfer roller 12, the registration roller pair 13, and the transport guides as an integrated unit makes it possible to accurately configure the transport guides for guiding sheets from the registration process, thereby improving sheet transportation accuracy. It is desirable to accurately transport the sheets especially in the transfer sections because images are transferred onto the sheets in the transfer section. Therefore, arranging the rollers and guides with an accurate positional relationship is an important factor for the image forming apparatus.

The registration roller pair 13 is driven by a driving force transferred by a main body drive force transferring member. The transfer of the driving force to the registration roller pair 13 is stopped when the front cover 30, which is rotatable between the closed position and the open position relative to the apparatus main body 1, is in the open position, and hence the jammed sheet is easily removed. A force for holding a sheet between the sheet feed roller 22 and the friction pad 23 may be made smaller than a force for holding a sheet between the rollers of the registration roller pair 13. With this configuration, a sheet jammed between the sheet feed roller 22, the friction pad 23, and the registration roller pair 13 remains in the transport unit 40 when the front cover 30 is opened, and therefore the sheet is easily removed. A force for holding a sheet between the rollers of the fixing roller pair 14*a* may be made smaller than the force for holding a sheet between the rollers of the registration roller pair 13. With this configuration, a sheet jammed between the fixing roller pair 14*a* and the registration roller pair 13 is released from the registration roller pair 13 when the transport unit 40 is exposed by opening the front cover 30, and therefore the sheet is easily removed.

Figure 9:
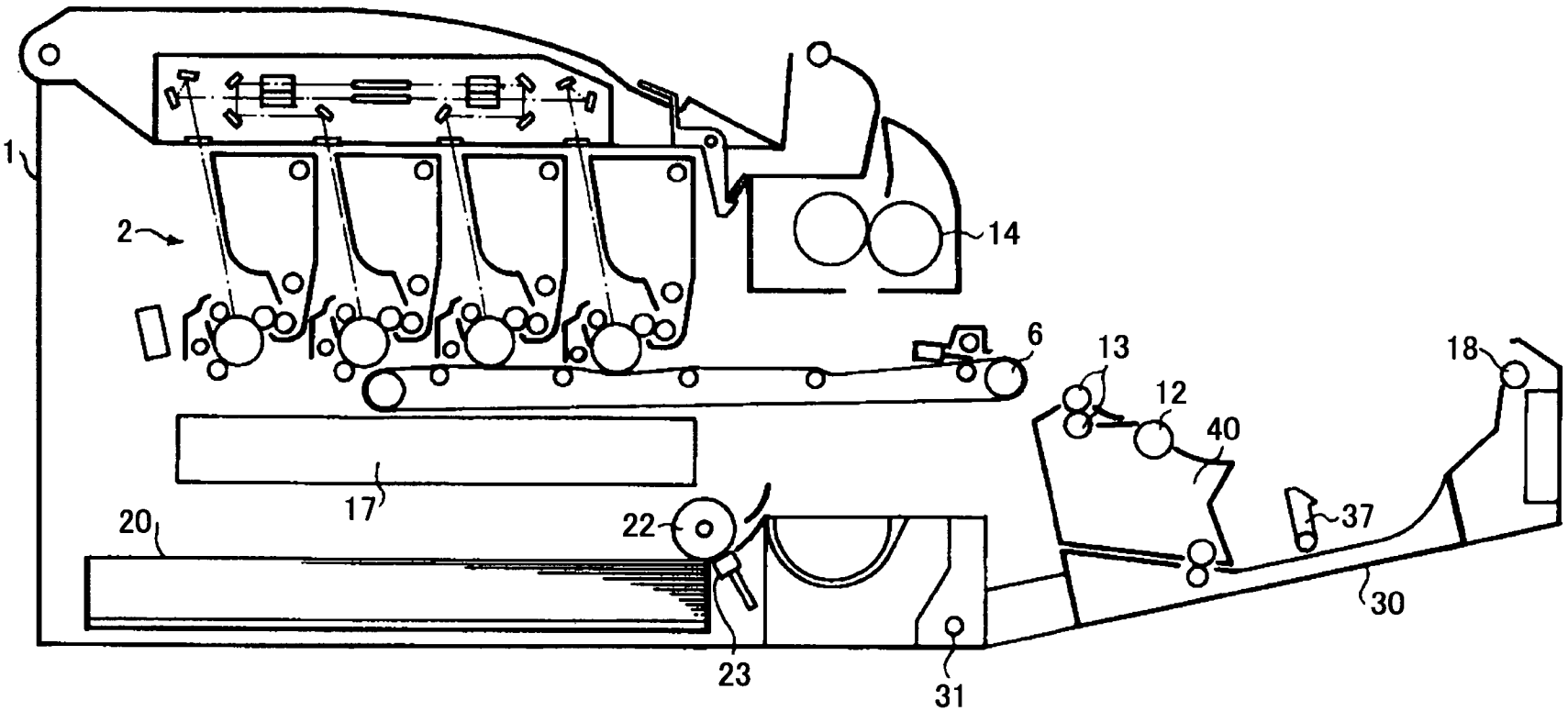
FIG. 9 is a cut-away side view schematically showing an image forming apparatus according to another embodiment of the present invention.

The present invention is applicable to an image forming apparatus shown in FIG. 9 which is configured such that, when the front cover 30 as a rotatable part is in the open position, not only the section before the fixing unit 14 but also an ejection roller 18 are exposed. That is, the present invention is applicable to an image forming apparatus whose front cover 30 has a height extending substantially from the lowermost part through the uppermost part of the apparatus main body 1. However, this image forming apparatus is also configured such that the fixing unit 14 is not exposed even when the front cover 30 is in the open position.

The present application is based on Japanese Priority Application No. 2006-162350 filed on Jun. 12, 2006, Japanese Priority Application No. 2007-102551 filed on Apr. 10, 2007, and Japanese Priority Application No. 2007-114172 filed on Apr. 24, 2007, with the Japanese Patent Office, the entire contents of which are hereby incorporated by reference.

What is claimed is:

1. An image forming apparatus comprising:

an apparatus main body;

a first unit removably attached inside the apparatus main body and configured to horizontally move relative to a surface on which the image forming apparatus is located;

a rotatable part attached to the apparatus main body and rotatable between an open position for opening the apparatus main body and a closed position for closing the apparatus main body; and a second unit removably attached to the rotatable part, wherein the first unit is configured to contact the second unit when the first unit is horizontally moved and the second unit is attached to the rotatable part;

when the rotatable part is in the open position, the first unit is allowed to be attached to or removed from the apparatus main body by being moved horizontally, the first unit is attached to or removed from the apparatus main body without coming into contact with the second unit when the second unit is removed from the rotatable part, a transport path is located between the second unit and the rotatable part, and the transport path is configured to be exposed when the second unit is removed from the rotatable part.

2. The image forming apparatus as claimed in claim 1, wherein the rotatable part includes a support member that supports the second unit attached to the rotatable part in a manner movable for adjustment in directions toward and away from the rotatable part.

3. The image forming apparatus as claimed in claim 2, wherein the rotatable part includes a biasing member that exerts an elastic force on the second unit in the direction away from the rotatable part.

4. The image forming apparatus as claimed in claim 3, wherein the second unit includes a positioning portion that is brought into contact with a predetermined portion of the apparatus main body due to the elastic force of the biasing member.

5. The image forming apparatus as claimed in claim 4, wherein, when the rotatable part is rotated from the open position to the closed position, the positioning portion is pressed against the predetermined portion of the apparatus main body by the biasing member, so that the second unit is positioned.

6. The image forming apparatus as claimed in claim 2, wherein the support member includes a locking claw slidably movable between an engaging position for engaging a locking portion of the second unit and a disengaging position for releasing the engagement, the locking claw having a taper portion that, during attachment of the second unit, comes into contact with the locking portion to cause the sliding movement of the locking claw from the engaging position to the disengaging position.

7. The image forming apparatus as claimed in claim 6, wherein the locking claw is constantly biased by a force that moves the locking claw to the engaging position so that, when the locking portion moves over the taper portion during attachment of the second unit, the locking claw returns to the engaging position.

8. The image forming apparatus as claimed in claim 1, wherein the second unit includes a registration roller for registration of a sheet.

9. The image forming apparatus as claimed in claim 1, wherein handles are provided one on each longitudinal end of the second unit, the handles being operated for removing the second unit from the rotatable part.

10. The image forming apparatus as claimed in claim 1, wherein the first unit is attached to or removed from the apparatus main body without coming into contact with a registration roller of the second unit by removing the second unit from the rotatable part.

11. The image forming apparatus as claimed in claim 1, wherein the second unit is a transport unit that includes a pair of registration rollers and a transfer member and transports sheets fed from a sheet feed section to an image transfer section.

12. The image forming apparatus as claimed in claim 11, wherein the sheet feed section includes a transport roller for transporting the sheets and a separation member that separates the sheets adhering to each other, wherein a sheet holding force of the pair of registration rollers is greater than the a sheet holding force between the transport roller and the separation member.

13. The image forming apparatus as claimed in claim 11, wherein a fixing unit including a pair of fixing rollers is disposed downstream of the pair of registration rollers in a sheet transport direction, wherein a sheet holding force of the pair of fixing rollers is greater than a sheet holding force of the pair of registration rollers.

14. The image forming apparatus as claimed in claim 1, wherein the first unit includes at least an intermediate transfer belt.

* * * * *